US007993216B2

(12) United States Patent
Lee

(10) Patent No.: US 7,993,216 B2
(45) Date of Patent: Aug. 9, 2011

(54) GOLF CLUB HEAD OR OTHER BALL STRIKING DEVICE HAVING MULTI-PIECE CONSTRUCTION

(75) Inventor: David S. Lee, Wenham, MA (US)

(73) Assignee: Nike, Inc., Beaverton, OR (US)

( * ) Notice: Subject to any disclaimer, the term of this patent is extended or adjusted under 35 U.S.C. 154(b) by 36 days.

(21) Appl. No.: 12/272,442

(22) Filed: Nov. 17, 2008

(65) Prior Publication Data

US 2010/0125000 A1 May 20, 2010

(51) Int. Cl.
*A63B 53/04* (2006.01)

(52) U.S. Cl. ..... 473/334; 473/338; 473/345; 473/349

(58) Field of Classification Search ..... 473/324–350, 473/287–292
See application file for complete search history.

(56) References Cited

U.S. PATENT DOCUMENTS

| | | | | |
|---|---|---|---|---|
| 5,328,176 | A * | 7/1994 | Lo | 473/342 |
| 5,624,331 | A * | 4/1997 | Lo et al. | 473/345 |
| 5,997,415 | A * | 12/1999 | Wood | 473/346 |
| 6,059,669 | A * | 5/2000 | Pearce | 473/339 |
| 6,074,308 | A * | 6/2000 | Domas | 473/327 |
| 6,332,848 | B1 * | 12/2001 | Long et al. | 473/328 |
| 6,440,009 | B1 * | 8/2002 | Guibaud et al. | 473/334 |
| 6,527,650 | B2 * | 3/2003 | Reyes et al. | 473/345 |
| 6,739,983 | B2 * | 5/2004 | Helmstetter et al. | 473/342 |
| 7,108,612 | B2 * | 9/2006 | Nakahara et al. | 473/329 |
| 7,318,782 | B2 * | 1/2008 | Imamoto et al. | 473/345 |
| 7,371,191 | B2 * | 5/2008 | Sugimoto | 473/345 |
| 2002/0187853 | A1 * | 12/2002 | Beach et al. | 473/345 |
| 2003/0083151 | A1 | 5/2003 | Nakahara et al. | |
| 2003/0134692 | A1 | 7/2003 | Nakahara et al. | |
| 2004/0023731 | A1 * | 2/2004 | Chen | 473/345 |
| 2004/0192468 | A1 * | 9/2004 | Onoda et al. | 473/345 |
| 2005/0209024 | A1 | 9/2005 | Oyama | |
| 2005/0215354 | A1 | 9/2005 | Kumamoto | |
| 2007/0155533 | A1 * | 7/2007 | Solheim et al. | 473/334 |
| 2008/0102978 | A1 | 5/2008 | Burnett et al. | |
| 2009/0105010 | A1 * | 4/2009 | De La Cruz et al. | 473/345 |

FOREIGN PATENT DOCUMENTS

| | | |
|---|---|---|
| EP | 1559450 | 3/2005 |
| GB | 2417909 | 3/2006 |
| WO | 2004043550 | 5/2004 |

OTHER PUBLICATIONS

International Search Report and Written Opinion from PCT Application No. PCT/US2009/064302, mailed Oct. 4, 2010.

* cited by examiner

*Primary Examiner* — Sebastiano Passaniti
(74) *Attorney, Agent, or Firm* — Banner & Witcoff, Ltd.

(57) ABSTRACT

A ball striking device has a head that includes a metal face configured for striking a ball, a rearwardly extending metal band, a top piece, and a bottom piece. The metal band has a first end extending from one side of the face, a second end extending from the opposite side of the face, and a rear portion extending between the first and second ends and defining at least a portion of the rear periphery of the head. The top piece and the bottom piece are non-metallic or substantially non-metallic. The top piece is connected to the top side of the metal band and forms at least a portion of a top side of the head, and the bottom piece is connected to the bottom side of the metal band and forms at least a portion of a bottom side of the head. The top piece and the bottom piece are separated by the metal band.

33 Claims, 7 Drawing Sheets

GOLF CLUB HEAD OR OTHER BALL STRIKING DEVICE HAVING MULTI-PIECE CONSTRUCTION

TECHNICAL FIELD

The invention relates generally to ball striking devices, such as golf club heads, having a multi-piece construction, and more particularly, to such ball striking devices having both metallic and non-metallic components.

BACKGROUND OF THE INVENTION

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world. The number of individuals participating in the game and the number of golf courses have increased steadily over recent years.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Like other golf clubs, drivers and other "woods" also must make square contact with the golf ball, in the desired direction or path, in order to produce straight and true shots in the desired direction. Even small deviations from squareness between the club head and the golf ball at the point of contact can cause inaccuracy. Further, because drivers typically hit the ball over greater distances than other clubs, these inaccuracies can be exaggerated. Accordingly, club head features that can ensure that the club face is square to the ball at the point of contact will tend to help the ball fly straighter, truer, and in the desired direction. Features that reduce twisting of the club head on off-center shots will keep the club head more square to the ball during contact. Strategic weighting of the club head can greatly affect its performance in this regard.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of at least some of its aspects. This summary is not an extensive overview of the invention. It is not intended to identify key or critical elements of the invention or to delineate the scope of the invention. The following summary merely presents some concepts of the invention in a general form as a prelude to the more detailed description provided below.

One aspect of the invention relates to ball striking devices, such as golf clubs, with a head that includes a metal face configured for striking a ball, a metal band, a top piece, and a bottom piece. The metal band has a first end extending from one side of the face, a second end extending from the opposite side of the face, and a portion extending around and defining at least a portion of the rear periphery of the club head, and extending between the first and second ends. The top piece and the bottom piece are non-metallic or substantially non-metallic. The top piece is connected to the top side of the metal band and forms at least a portion of a top side of the head, and the bottom piece is connected to the bottom side of the metal band and forms at least a portion of a bottom side of the head. The top piece and the bottom piece are separated by the metal band.

According to one aspect, the face and the band are made from the same metallic material, and the top piece and the bottom piece are made from carbon fiber-polymer composite materials.

According to another aspect, the face and the band are formed separately and are connected by an integral joining technique (such as by welding, brazing, soldering, or other fusing techniques), and the top piece and the bottom piece are connected to the band by an adhesive.

According to additional aspects, the head may further include a metal arm extending across the bottom side of the head from the face to a rear, central location of the band. The bottom piece is connected to a portion of the bottom side of the band and a first side of the arm. Additionally, the head may include another bottom piece connected to another portion of the bottom side of the band and a second, opposed side of the arm, such that the two bottom pieces are separated by the arm. The metal arm and the metal band may be separately formed and joined to one another or may be formed together as a single, unitary piece.

According to further aspects, the face is formed as a cup-face structure including a face member and at least one wall extending rearwardly from a periphery of the face member, and the metal band is formed separately from the cup-face structure and is connected to the cup-face structure by the at least one wall. Additionally, the top piece may be connected to the top side of the metal band and a back side of the face or the rearward extending wall or rim of the cup face. The head may also include at least one weight member connected to the metal band or other structural member of the head.

Other aspects of the invention relates to ball striking devices, such as golf clubs, with a head that includes a metal front piece, a metal back piece, a top piece and a bottom piece. The metal front piece includes a face configured for striking a ball. The metal back piece is connected to the front piece and defines a first opening on a top side thereof and a second opening on a bottom side thereof. The top piece and the bottom piece are non-metallic or substantially non-metallic. Additionally, the top piece is connected to the back piece and is positioned to at least partially cover the first opening, and the bottom piece is connected to the back piece and is positioned to at least partially cover the second opening, such that the back piece separates the bottom piece and the top piece.

According to one aspect, the back piece further defines a third opening on the bottom side thereof. The head further includes another bottom piece that is connected to the back piece and positioned to at least partially cover the third opening, such that the two bottom pieces do not contact one another and do not contact the top piece.

Further aspects of the invention relate to golf club heads incorporating the features of the ball striking devices described above. Additionally, the ball striking device may be a golf club, which includes a golf club head with a handle or shaft extending therefrom.

Still further aspects of the invention relate to methods for manufacturing ball striking devices, e.g., of the types described above, which include forming a metal front piece with a face configured for striking a ball and forming a metal back piece, and connecting the front piece to the back piece such that the back piece defines a first opening on a top side thereof and a second opening on a bottom side thereof. Additionally, a substantially non-metallic top piece and a substantially non-metallic bottom piece are formed. The top piece is connected to the back piece such that the top piece is positioned to at least partially cover the first opening, and the bottom piece is connected to the back piece such that the bottom piece is positioned to at least partially cover the second opening. When assembled, the back piece separates the bottom piece from the top piece.

Other features and advantages of the invention will be apparent from the following specification taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
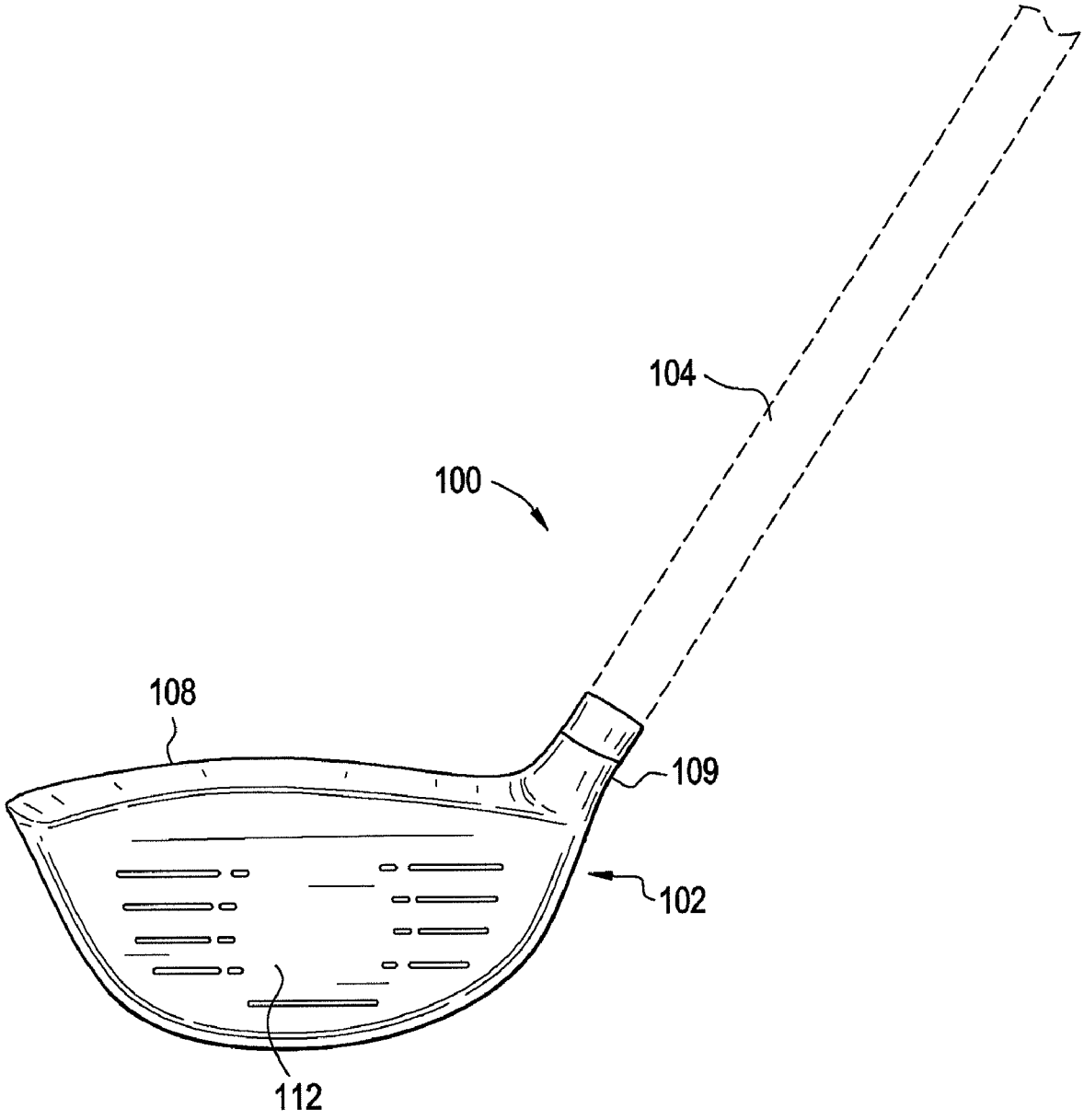
FIG. 1 is a front view of one embodiment of a ball striking device according to the present invention.
Figure 2:
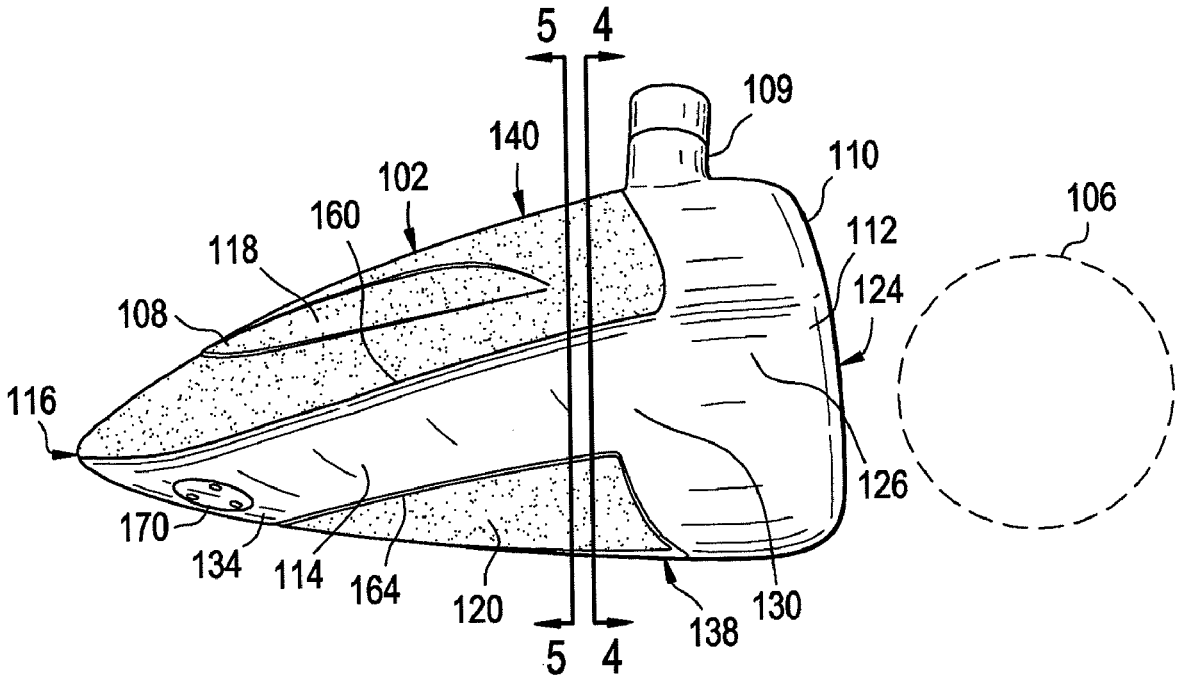
FIG. 2 is a side view of a head of the ball striking device of FIG. 1, shown with a ball.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Molding" generally includes any of a variety of processes for structural shaping through conforming a material to the shape of a mold or similar tool, including, without limitation, various types of liquid-state, solid-state, and powder-based molding techniques, and combinations thereof, including composite molding techniques.

"Substantially non-metallic" means a material containing a substantial non-metallic structure, including a non-metallic matrix or a non-metallic filler material, or any material generally that contains around 80% or more undissolved non-metallic material by volume.

"Non-metallic" means a material containing no substantial metallic structure, such as a metallic matrix, or any material generally that contains around 95% or more non-metallic material by volume.

"Metal" and "Metallic" include both pure metals and metal alloys, as well as metal matrix composites, metal foams, composite-reinforced metal structures, and other known metallic materials.

"Integral joining technique" means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto.

Terms such as "first," "second," "third," "top," "bottom," "front," "rear," etc., as used herein, are intended for illustrative purposes only and do not limit the embodiments. Additionally, the term "plurality," as used herein, indicates any number greater than one, either disjunctively or conjunctively, as necessary, up to an infinite number.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including drivers, fairway woods, wood-type hybrid clubs, and the like.

According to various aspects, the ball striking device may be formed of one or more of a variety of materials, such as metals (including metal alloys), ceramics, polymers, composites, and wood, and may be formed in one of a variety of configurations, without departing from the scope of the invention. According to one aspect, the ball striking device has a head formed of multiple pieces made from different materials. For example, the face is made of a first material, and at least some components of the head are made of another material. In one embodiment, some components of the head, including the face and a band extending around a portion of the head, are made of metal (including metal alloys), and other components of the head are made of non-metallic or substantially non-metallic materials. Additionally, the components may be formed by various forming methods. For example, metal components may be formed by forging, molding, casting, machining, and/or other known techniques. In another example, substantially non-metallic composite components, such as carbon fiber-polymer composites, can be manufactured by a variety of composite processing techniques, such as prepreg processing, powder-based techniques, mold infiltration, and/or other known techniques. In one embodiment, the metal components are formed by forging and are then polished and machined to the proper dimensions and finishes, and the composite components are formed by using prepregs.

Aspects of the invention also relate to methods for forming a ball striking device, which incorporate the use of multiple pieces and multiple materials as described above. In one embodiment, metal components and non-metallic or substantially non-metallic components are formed and joined together to form a head for the ball striking device.

The various figures in this application illustrate examples of ball striking devices according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs. Such devices may include a one-piece construction or a multiple-piece construction. An example structure of a ball striking device according to this invention will be described in detail below in conjunction with FIGS. 1-8, and referred to generally using reference numeral "100."

FIG. 1 illustrates an example of a ball striking device 100 in the form of a golf driver, in accordance with at least some examples of this invention. The ball striking device 100 includes a ball striking head 102 and a shaft 104 connected to the ball striking head 102 and extending therefrom. A ball 106 in use is also schematically shown in FIG. 2, in a position to be struck by the ball striking device 100.

The ball striking head 102 of the ball striking device 100 of FIG. 1 is shown in further detail in FIGS. 2-6. In the example structure shown in FIGS. 1-6, the ball striking head 102 has a body 108 with a hosel 109 extending therefrom. The shape and design of the head 102 may be partially dictated by the intended use of the device 100. In the club 100 shown in FIGS. 1-6, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art.

Generally, the head 102 has a multi-piece construction, including a frame made of one material and at least one other piece made from a second material. In one embodiment, the head 102 includes at least one metal piece and at least one non-metallic or substantially non-metallic piece that are connected together to form the head 102. In the structure shown in FIGS. 1-6, the head 102 includes the face 112 and a rearwardly extending band 114 that extends from the face 112 toward the rear 116 of the head 102, as well as at least one top piece 118 and at least one bottom piece 120, 122 that are made from a different material from the face 112 and band 114. In one example structure, the face 112 and the band 114 are made of a metal material, and the top piece 118 and bottom pieces 120, 122 are made of non-metallic or substantially non-metallic materials. For example, the face 112 and band 114 may be made from a titanium alloy in one embodiment, and may be made from different metals in other embodiments (e.g., steels, aluminum, nickel, magnesium, and/or their alloys). As another example, the top and bottom pieces 118, 120, 122 are made from a carbon fiber-polymer composite, such as a graphite-epoxy composite, in one embodiment, and may be made from different polymers or composites or other non-metallic or substantially non-metallic materials in other embodiments (e.g., basalt fiber based composites, glass fiber based composites such as fiberglass, polymeric materials, etc.). It is contemplated that the face 112 and band 114 may be made from the same metal; however, in other embodiments, the face 112 and band 114 may be made from different metals, and one or both of the face 112 and band 114 may not be metallic. Similarly, it is contemplated that the top and bottom pieces 118, 120, 122 may be made from the same material; however, in other embodiments, the one or more of the top and bottom pieces 118, 120, 122 may be made from different materials. A non-exhaustive list of materials which may be suitable for use for various components of the head 102 includes: metals, ceramics, polymers, composites, and wood.

The face 112 is located at the front 124 of the head 102, and has a ball striking surface 110 located thereon. The ball striking surface 110 is configured to face a ball 106 in use, and is adapted to strike the ball 106 when the device 100 is set in motion, such as by swinging. As shown, the ball striking surface 110 is relatively flat and planar, occupying most of the face 112. The face may include some curvature in the top to bottom and/or heel to toe directions (e.g., bulge and roll radii), as is known and is conventional in the art. In other embodiments, the surface 110 may occupy a different proportion of the face 112, or the body 108 may have multiple ball striking surfaces 110 thereon. In the embodiment shown, the ball striking surface 110 is inclined slightly (i.e., a loft angle), to give the ball 106 slight lift and spin when struck. In other embodiments, the ball striking surface 110 may have a different incline or loft angle, to affect the trajectory of the ball 106. Additionally, the face 112 may have a variable thickness in some embodiments. For example, the face 112 of the head 102 shown in FIGS. 1-6 has a thickened portion 113 proximate the center of the face 112, as illustrated in FIG. 4. It is understood that the face 112 may have an internal or external insert that may be made of a different metallic or non-metallic material than the bulk of the face 112. In further embodiments, the face may be made of a non-metallic or substantially non-metallic material, or the face 112 could be a thinner, reinforced, multi-material face.

Figure 3:
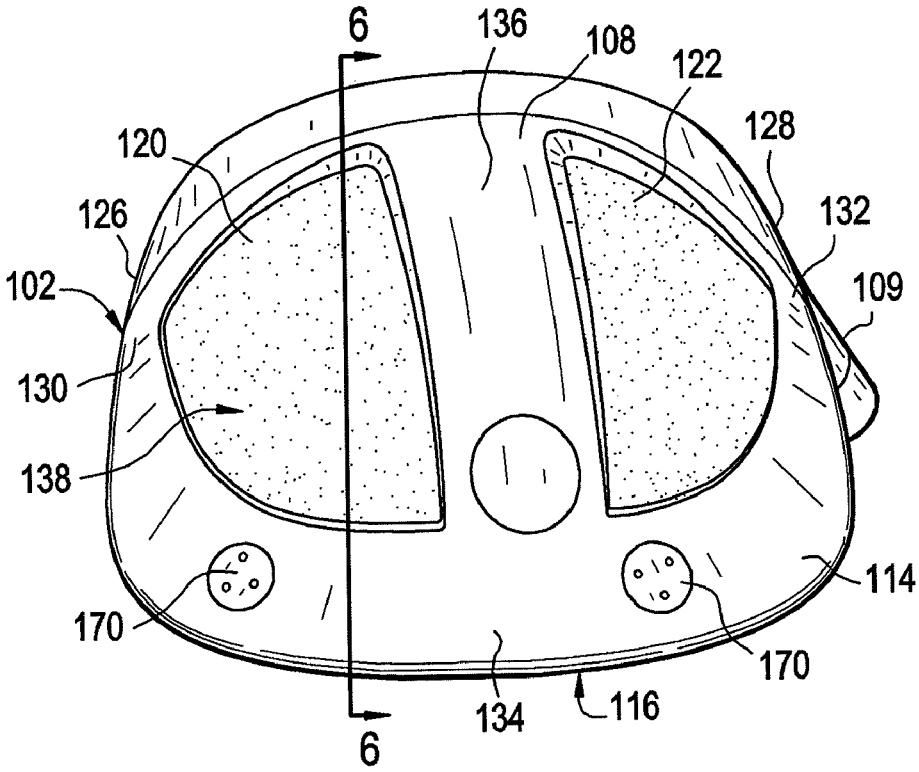
FIG. 3 is a bottom view of the head of FIG. 2.
Figure 4:
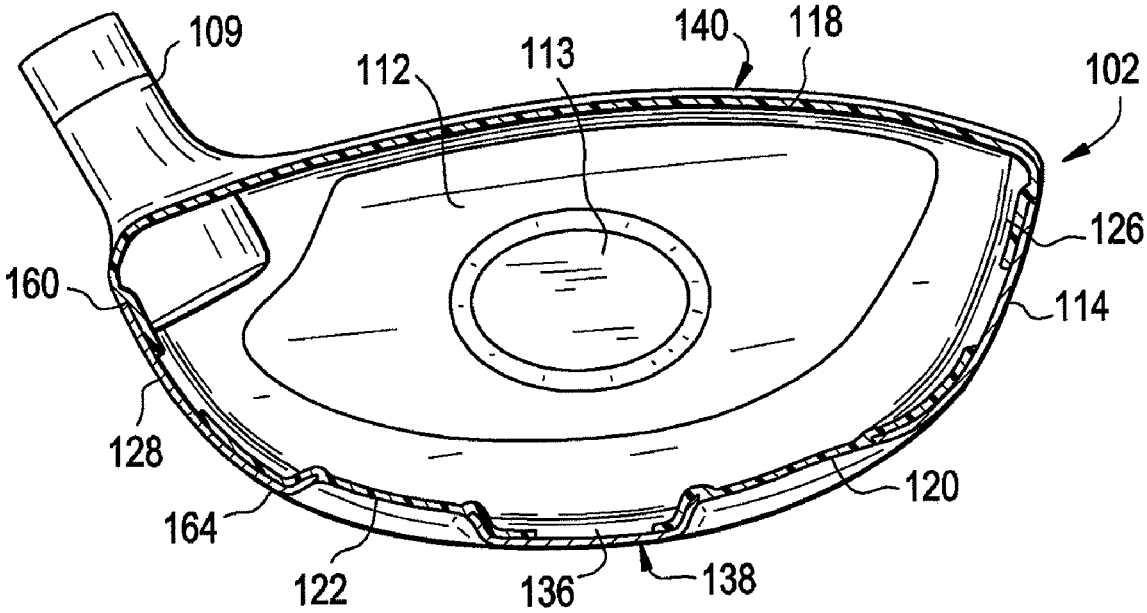
FIG. 4 is a cross-sectional view taken along lines 4-4 of FIG. 2.
Figure 5:
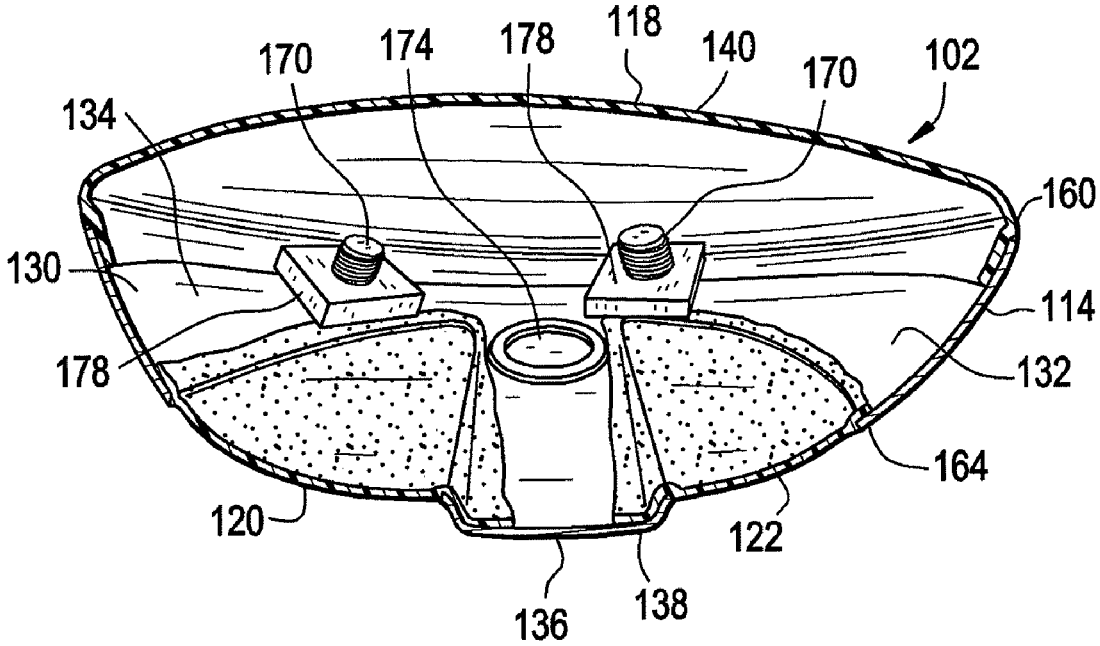
FIG. 5 is a cross-sectional view taken along lines 5-5 of FIG. 2.

In the embodiment of FIGS. 1-6, the band 114 is connected to opposed sides 126, 128 of the face 112 and extends to the rear 116 of the head 102 and around the entire periphery of the head 102. The band 114 has a first end 130 connected to, and extending from, one side 126 of the face 112 and a second end 132 connected to, and extending from, the opposite side 128 of the face 112. A rear portion 134 extends between the ends 130, 132 of the band 114 and gives the band 114 its shape. In the embodiment illustrated, the rear portion 134 is a semi-circular curved portion, but may have another desired shape, such as a more rectangular shape, as is known in the art. Additionally, as shown in FIGS. 3-5, the illustrated example of the band 114 includes an arm 136 extending across the bottom 138 of the head 102, from the bottom of the face 112 to the rear 116 of the head 102. In other embodiments, the band 114 may have a different configuration. In some examples, the band 114 can be positioned higher or lower on the head 102, the band 114 can have a different or variable width or profile, the band 114 may extend around the head 102 in a different direction or orientation, or the band 114 may not extend around the entire periphery of the head 102. Further, the band 114 may not have the arm 136 or may have more than one arm 136, and the arm 136 may be designed and oriented differently, such as extending across the top 140 of the head 102. In one embodiment, as described above, the band 114 is made entirely or substantially of a metallic material, and may be made from the same material as the face 112. In alternate embodiments, the band 114 may be made from a non-metallic or substantially non-metallic material, and may be made from a different material than the face 112.

In the embodiment described above, where the face 112, the band 114, the arm 136, and/or other pieces of the head 102 are metal, such pieces can be formed as a single piece or as separate pieces that are joined together. In one embodiment, the face 112 and the band 114 are formed as separate pieces that are joined by an integral joining technique, such as welding. Other known techniques for metal joining can be used as well, including many mechanical joining techniques.

Figure 6:
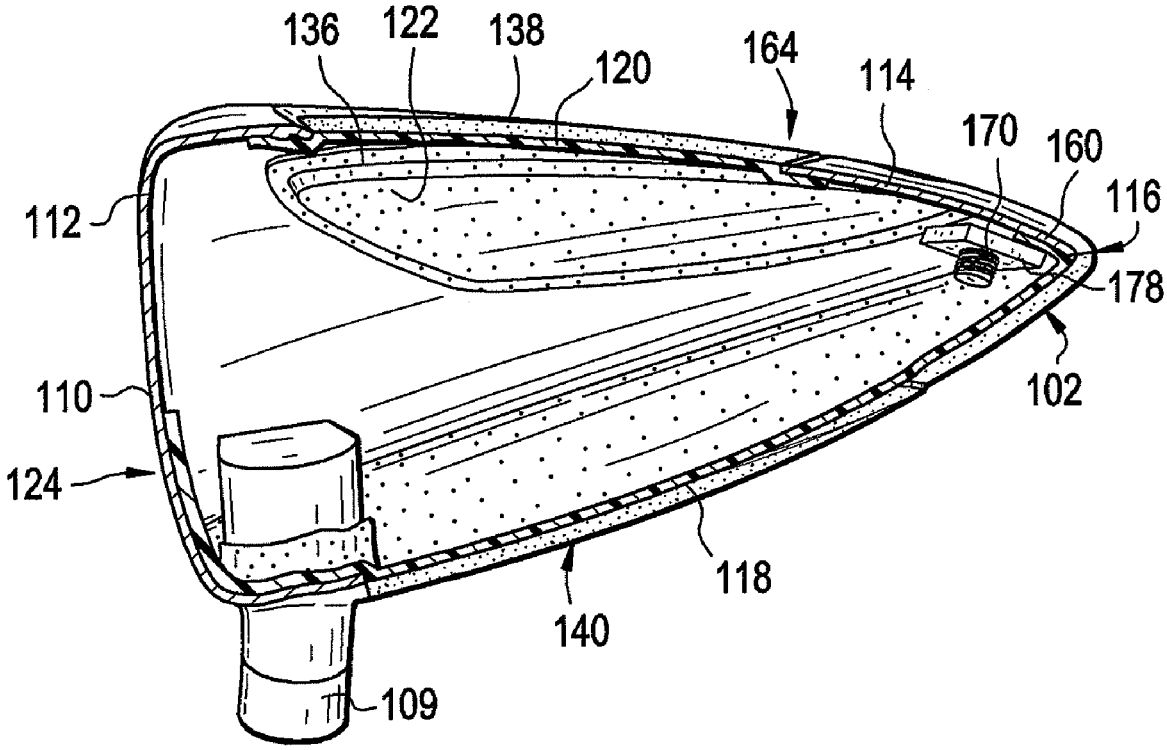
FIG. 6 a cross-sectional view taken along lines 6-6 of FIG. 3.
Figure 7:
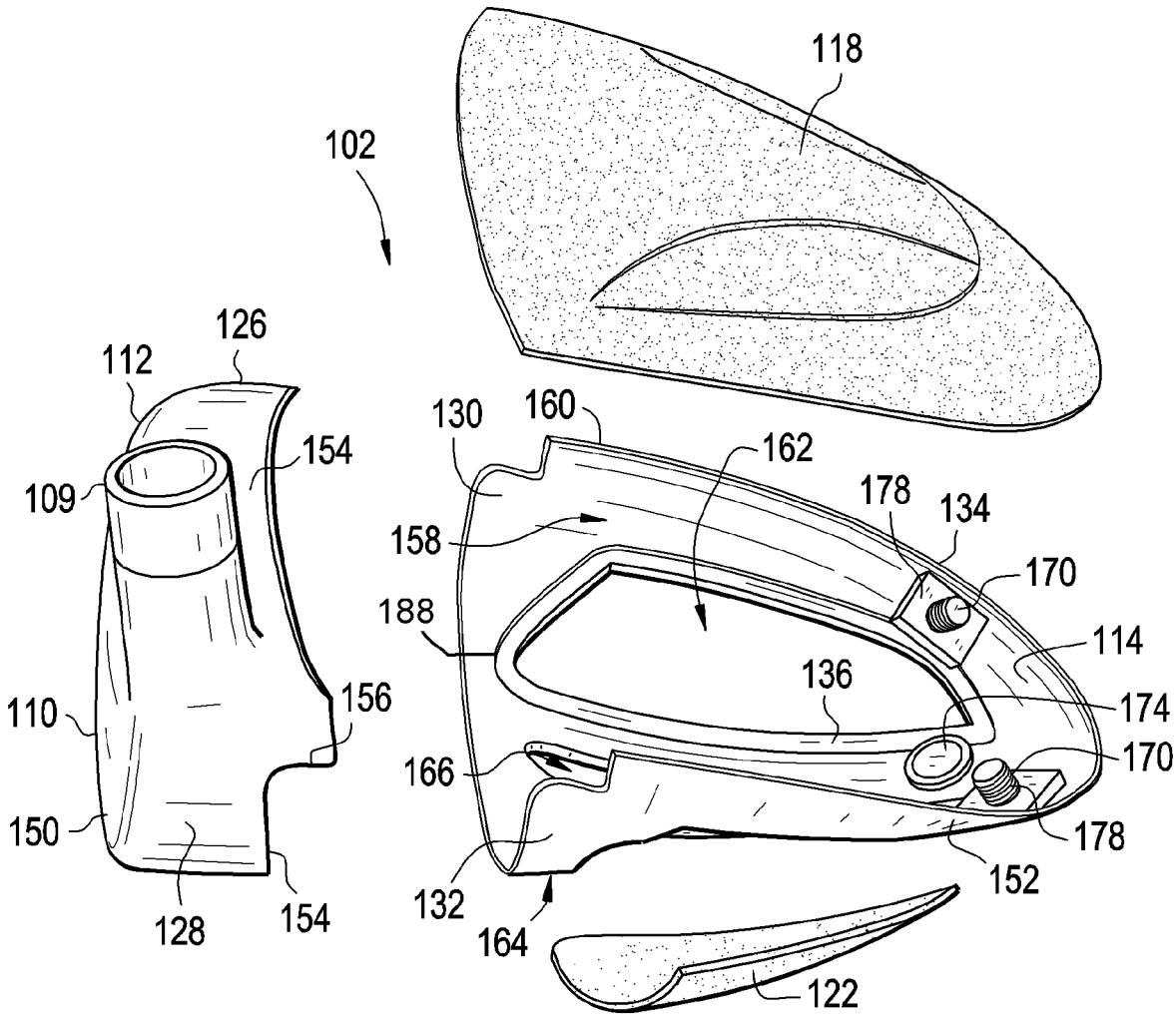
FIG. 7 is a side exploded view of one embodiment of a set of components that can be assembled to form the head of FIG. 2.
Figure 8:
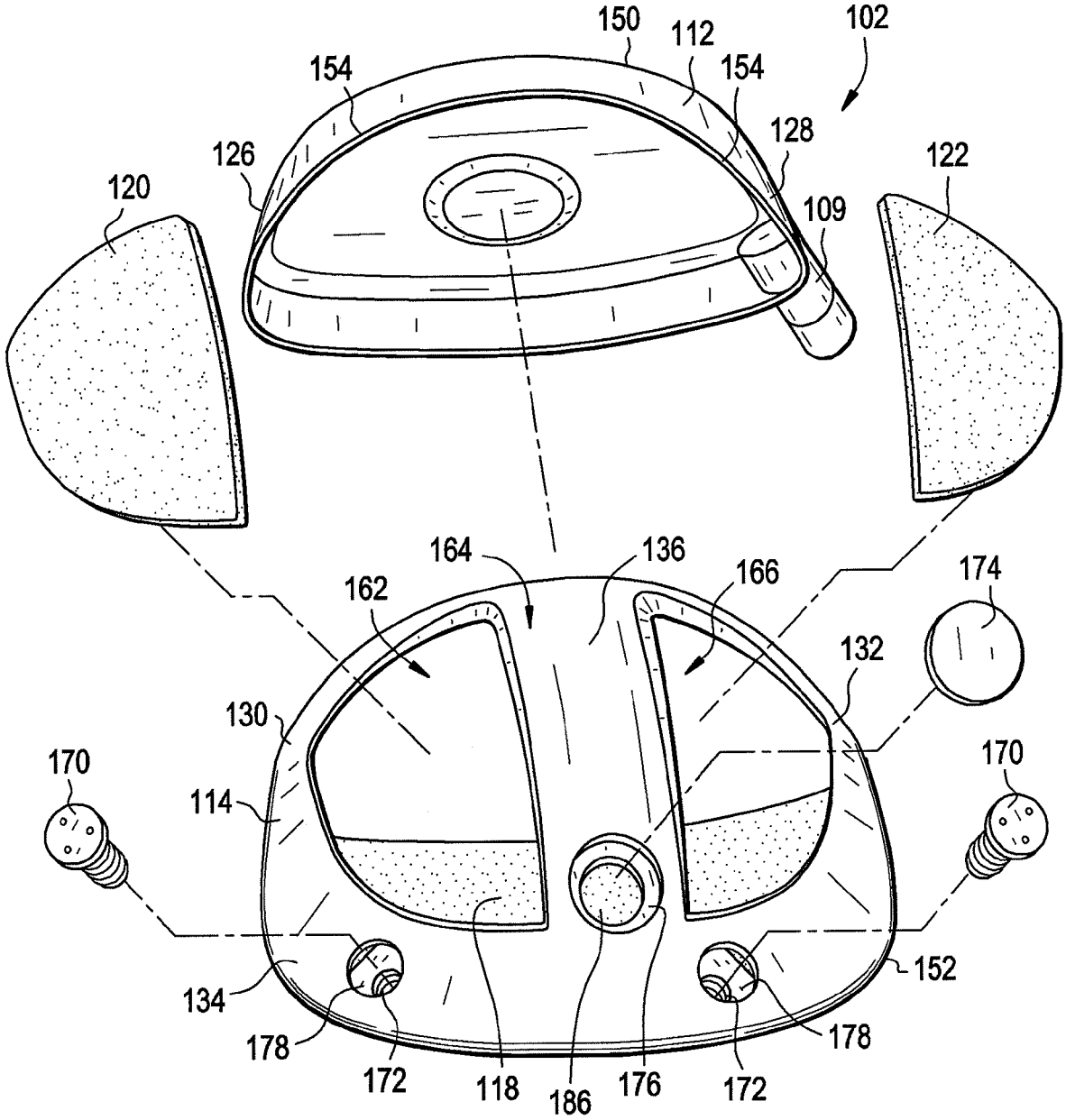
FIG. 8 is a rear exploded view of the set of components depicted in FIG. 7.

FIGS. 7-8 illustrate one embodiment of forming a head 102 as shown in FIGS. 1-6 using multiple pieces. In this embodiment, the face 112 and the band 114 are parts of two separate pieces 150, 152 that are joined together to form a part of the head 102. The face 112 is located on a front piece 150, which has the face 112 and walls 154 extending backward from the face 112. In this embodiment, the walls 154 extending from the periphery of the face 112 give the front piece 150 a cup-like shape, known as a "cup face." The walls 154 (also called a "return portion") shown in FIGS. 7-8 have jogs 156 so that the top and bottom walls 154 are staggered from each other. However, in other embodiments, the walls 154 may all be of equal length, or another configuration. The walls 154 of the return portion may be, for example, from 0.25 inches long to 2 inches long. In the embodiment illustrated in FIGS. 7-8, the hosel 109 is connected to the front piece 150 prior to assembly of the head 102, however, in other embodiments, the hosel 109 may have a different configuration, or the head 102 may contain no hosel 109 or an internal hosel. If desired, the hosel 109 may be integrally formed as part of the cup face as part of piece 150.

In the embodiment illustrated in FIGS. 7-8, the band 114 and the arm 136 are formed as part of a back piece 152 that is connected to the front piece 150. The back piece 152 defines at least a first opening 158 on the top side 160 thereof and a second opening 162 on the bottom side 164 thereof. In the embodiment of FIGS. 7-8, the back piece 152 also defines a third opening 166 on the bottom side 164 thereof, with the second and third openings 162, 166 positioned on opposed sides of the arm 136. The back piece 152 is connected to the front piece 150 by connecting to the walls 154 in any manner described herein. In one embodiment, the front and back pieces 150, 152 are integrally joined together to form a single piece once connected.

As illustrated in the embodiments of FIGS. 1-8, the head 102 has at least one top piece 118 on the top side 140 of the head 102 and at least one bottom piece 120, 122 on the bottom side 138 of the head 102. Additionally, the at least one top piece 118 is separated from the at least one bottom piece 120, 122 by the band 114, and the top piece 118 does not contact the bottom pieces 120, 122. If desired, the front piece 150 and/or the back piece 152 may be formed with ledges, ridges, grooves, etc., on which the top piece 118 and/or the bottom pieces 120, 122 may be mounted. As shown in FIG. 7, the head 102 may have ridges 188 around the openings 158, 162, 166 to provide a surface for the top and bottom pieces 118, 120, 122 to "grip" onto when they are formed into place, as described below. In the embodiments shown, the top piece 118 and bottom pieces 120, 122 are separate pieces from the face 112 and the band 114, and are joined together during the manufacturing process. Additionally, in the embodiments shown, the top piece 118 and bottom pieces 120, 122 are made from different materials from the face 112 and/or the band 114.

Generally, the top piece 118 is positioned on the top side 160 of the band 114 and forms at least a portion of the top 140 of the head 102. Additionally, the top piece 118 is positioned in the top opening 158 defined by the back piece 152. In the embodiments shown in FIGS. 1-8, the top piece 118 forms a majority of the top 140 of the head 102, and is connected to the top side 160 of the band 114 as well as the walls 154 extending from the face 112, e.g., by an adhesive connection. In other embodiments, the top piece 118 may be larger or smaller, and the head may contain multiple pieces on the top 140 of the head 102 which may be joined or separate from each other.

Generally, the one or more bottom pieces 120, 122 are positioned on the bottom side 164 of the band 114 and form at least a portion of the bottom 138 of the head 102. Additionally, the one or more bottom pieces 120, 122 are positioned in the one or more bottom openings 162, 166 defined by the back piece 152. In the embodiment shown in FIGS. 7-8, the first bottom piece 120 is positioned in the second opening 162, and is connected to the bottom side 164 of the band and one side of the arm 136, and the second bottom piece 122 is positioned in the third opening 166, and is connected to the bottom side 164 of the band and the opposite side of the arm 136. Additionally, as shown in FIGS. 4-6, the bottom pieces 120, 122 can be recessed from the bottom 138 of the head 102. It is understood that when multiple openings are defined in either the top or bottom sides of the band 114, these openings may be the same or differently sized.

The top and bottom pieces 118, 120, 122 can be connected to the front and back pieces 150, 152 by many known methods and techniques. As stated above, in one embodiment, the top and bottom pieces 118, 120, 122 are made from carbon fiber-polymer composite and the front and back pieces 150, 152 are metal. In this embodiment, the top and bottom pieces 118, 120, 122 can be joined to the front and back pieces 150, 152, for example, by use of an adhesive, cement, or similar substance. Other joining methods may be used for these or other materials.

The ball striking device 100 may include a shaft 104 connected to or otherwise engaged with the ball striking head 102. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. In other embodiments, at least a portion of the shaft 104 may be an integral piece with the head 102, and the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

The head 102 may also contain weight members 170, 174, which can be strategically placed on the head 102 in order to modify the weight distribution of the head 102. In the embodiments shown in FIGS. 1-8, the head 102 has two screw-style weights 170 that are connected to the band 114 or back piece 152 by turning into holes 172 formed in the band or back piece 152. As shown in FIGS. 5-8, threaded screw bases 178 are located proximate the holes 172 to allow for threading the weights 170 in place. The screw bases 178 add additional weight to the head 102. The head 102 also has a larger plate-style weight 174 that is connected to the band 114 or back piece 152 by inserting the weight 174 into a recess 176 and securing the connection with an adhesive. These weights 170, 174 may be different sizes or made of materials with different densities, in order to provide greater control over weighting. For example, in some embodiments weights 170, 174 of 3 g, 5 g, and/or 8 g can be used at various positions on the head 102. Additionally, at least some of the weights 170, 174 may be designed to be quickly and easily interchangeable with one another and/or with other heavier or lighter such weights, to provide instantaneous control over weighting. In other embodiments, the head 102 may not contain weight inserts 170, 174, or may contain a different number, type, and/or distribution of such weights. As another alternative, if desired, weight may be applied to other parts of the club head structure, such as to the top and/or bottom pieces 118, 120, 122, such as by being placed within the plies of a composite material making up the non-metallic members, or other known connections.

As illustrated in FIGS. 4-6, the head 102 may have a hollow center cavity, filled with air. However, in another embodiment, the head 102 could be filled with another material, such as a foam. In still further embodiments, the solid materials of the head may occupy a greater proportion of the volume, and the head may have a smaller cavity or no inner cavity at all.

Once assembled, the face 112 and the band 114 provide structural support and rigidity for the head 102. In one embodiment, the face 112 and band 114 form the entire structural component of the head 102, and the top and bottom pieces 118, 120, 122 are non-structural components. Stated another way, the head 102 can be designed so that sufficient structural strength and rigidity are provided by the face 112 and band 114, and the head 102 could function for striking a ball without the presence of the top and bottom pieces 118, 120, 122, which may be present merely to fill gaps between the face 112 and band 114 in accordance with applicable regulations. In such a configuration, the top and bottom pieces 118, 120, 122 may be made from a wider variety of materials, including lighter materials, as structural properties become less important. This configuration of the head 102 can also produce a more desirable sound when the ball is struck by the head 102.

Other aspects of the invention relate to methods for manufacturing a head for a ball striking device 100 as described above. In one embodiment, a metal piece is formed that has at least a face 112 and a band 114 having a first end 130 extending from one side 126 of the face 112, a second end 132 extending from the opposite side 128 of the face 112, and a rear portion 134 between the first and second ends. The rear portion 134 can have a semicircular/curved shape or other appropriate shape, as discussed above. A substantially non-metallic top piece 118 is connected to a top side 160 of the metal band 114 such that the top piece 118 forms at least a portion of a top side 140 of the head 102. Similarly, substantially non-metallic bottom pieces 120, 122 are connected to a bottom side 164 of the metal band 114 such that the bottom pieces 120, 122 form at least a portion of the bottom side 138 of the head 102. The top and bottom pieces 118, 120, 122 are connected to the metal band 114 and/or other portions of the club head such that the top piece 118 and the bottom pieces 120, 122 are separated by the metal band 114 and do not contact each other. As described above, more than one top piece or bottom piece may be used to construct the head, such as the embodiment of the head 102 described above and shown in FIGS. 7-8, which has two bottom pieces 120, 122.

In another embodiment, a metal back piece 152 and a metal front piece 150 are formed with the front piece 150 having a face 112 thereon. The front piece 150 is connected to the back piece 152 such that the back piece 152 defines a first opening 158 on the top side 160 thereof and a second opening 162 on the bottom side 164 thereof. A substantially non-metallic top piece 118 and a bottom piece 120 are formed and are connected to the back piece 152. When connected, the top piece 118 is positioned so as to at least partially cover the first opening 158, and the bottom piece 120 is positioned so as to at least partially cover the second opening 162, and the back piece 152 separates the bottom piece 120 from the top piece 118. As described above, more than one top piece or bottom piece may be used in manufacturing the head. In the embodiment shown in FIGS. 7-8, the back piece 152 has two openings 162, 166 on the bottom side 164 thereof, and two bottom pieces 120, 122 are each positioned in one of the two openings 162, 166. The two bottom pieces 120, 122 do not contact one another, as they are separated by the arm piece, and also do not contact the top piece 118.

The components used in the above-described methods may be formed using any of the forming techniques described herein. It is understood that the forming techniques used may depend on the selected materials. Additionally, the steps of the methods described herein can be performed in many different sequences. In different embodiments, the top and bottom pieces 118, 120, 122 may be formed and then connected to the metal components, or may be positioned in place on the metal parts before being fully formed. For example, the top and bottom pieces 118, 120, 122 may be formed using prepregs, which can be positioned in the correct places and then cured (optionally under pressure that at least partially forms the final shapes of the pieces 118, 120, and/or 122). Further, the components used in these methods may have additional features, such as those in the various embodiments described above.

Figure 9:
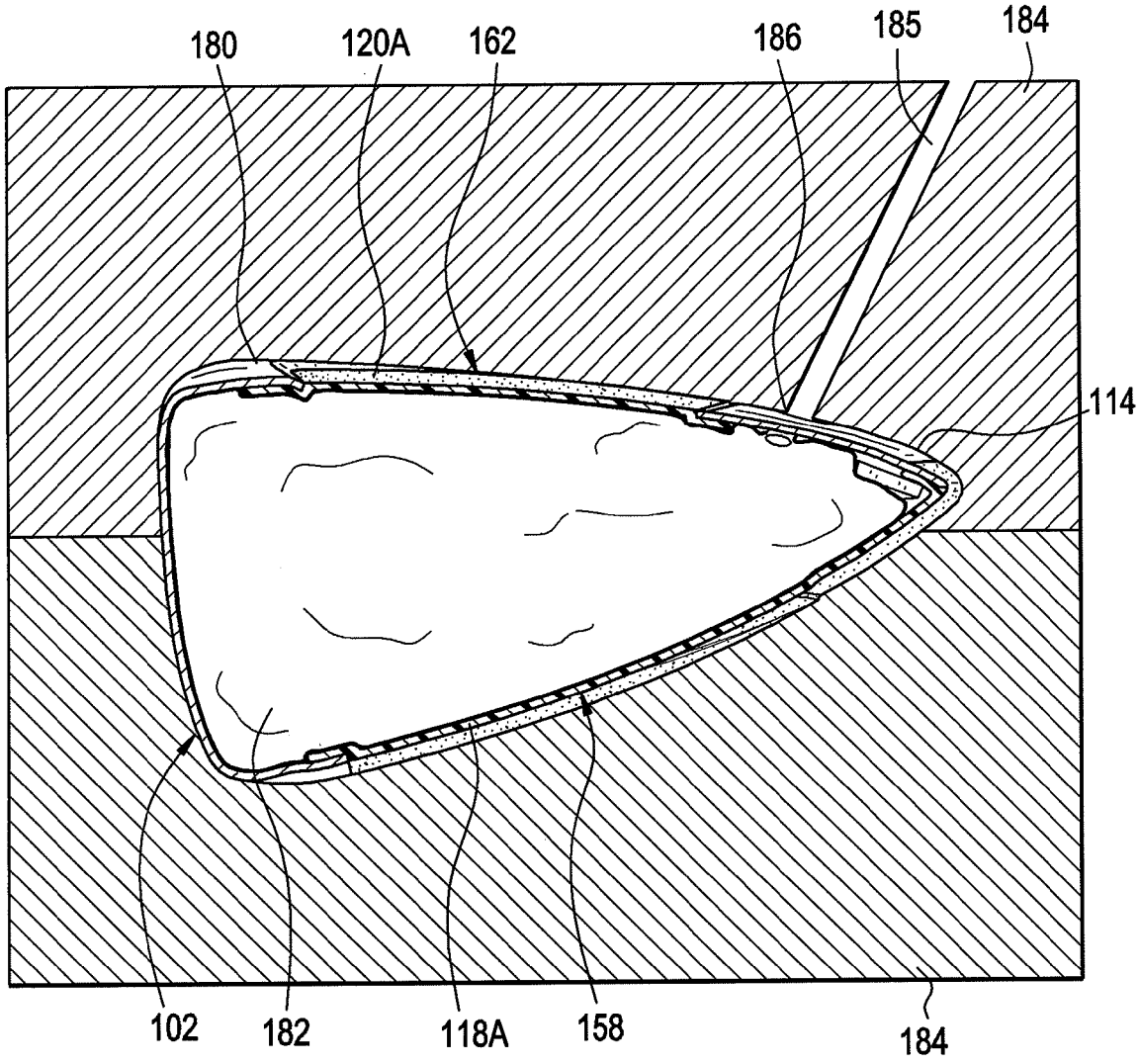
FIG. 9 is a cross-sectional view of one embodiment of a tool and process for forming a head of a ball striking device.

In one embodiment, the top and bottom pieces 118, 120, 122 are formed in place on an already-formed frame 180 made up of the face 112 and band 114, using prepregs or similar pre-formed curable and/or formable material. FIG. 9 illustrates one example of this forming process, using fiber-polymer resin composite prepregs 118A, 120A (prepreg for piece 122 is not shown). As shown in FIG. 9, the frame 180 has prepregs 118A, 120A positioned proximate the openings 158, 162, 166 and a bladder or balloon 182 is positioned within the frame 180 to force and hold the prepregs 118A, 120A in place during forming. The bladder 182 can be inserted into and removed from the frame 180 through an aperture 186 located in the recess 176, and an inflation line 185 can also be run through the aperture 186. In this embodiment, the prepregs 118A, 120A are larger than the openings 158, 162, 166, and are pushed into place in the openings 158, 162, 166 by the inflating of the bladder 182. The bladder 182 also pushes the prepregs 118A, 120A against external tools 184, to form the outer contours and shapes of the prepregs 118A, 120A. The band 114 shown in FIG. 7 has ridges 188 around the openings 158, 162, 166 provide a structure for the prepregs 118A, 120A to form around and grip onto, holding the prepregs 118A, 120A in place both during forming and after forming, when they form the top and bottom pieces 118, 120, 122.

After forming, the head 102 is treated to cure the prepregs 118A, 120A, such as by application of heat and/or pressure, forming the top and bottom pieces 118, 120, 122. In one embodiment, the curing is done with the bladder 182 and the tools 184 in place. The polymer resin in the prepregs 118A, 120A may provide sufficient adhesive-like bonding to the frame 180, depending on which resin is used. In other embodiments, a separate adhesive material may be used between the prepregs 118A, 120A and the frame 180 to ensure strong bonding. Once the bladder 182 is no longer needed, it can be removed from the head 102 through the aperture 186, and the insert 174 is attached in the recess 176 to cover the aperture 186. In another embodiment, the cavity formed by the frame 180 and prepregs 118A, 120A may be internally pressurized to form the prepregs 118A, 120A into place, rather than using the bladder 182.

The heads 102 manufactured by the above-described methods may be used as a ball striking device or a part thereof. For example, a golf club 100 as shown in FIG. 1 may be manufactured by attaching a shaft or handle 104 to the head 102. In other embodiments, different types of ball striking devices can be manufactured according to the principles described herein.

The ball striking devices and heads therefor as described herein provide many benefits and advantages over existing products. One such advantage is that the materials and configurations used may be selected in order to strategically weight the head to result in more effective striking of the ball. For example, in a golf club head, it is often desired to have the weight of the head distributed near the bottom and around the outer periphery of the head. In one such embodiment, the non-metallic pieces can be made of a lighter material than the metal components, and as a result, the metal portions of the head will be proportionally heavier. Thus, the metal components can be designed so that they occupy portions of the head which are desirably heavier, allowing greater control over the weight distribution of the head. Accordingly, a head with better properties, such as higher moment of inertia, can be produced. The addition of weight members at desired locations in the club head can provide additional strategic weighting of the head. Thus, the head can be selectively weighted so as to increase weight in the toe, heel, high, or low areas of the head. This selective weighting helps bias the club to produce selected ball flight trajectories, such as draw biased clubs, fade biased clubs, high trajectory biased clubs, and low trajectory biased clubs. This feature can help the club compensate for swing flaws, e.g., which may tend to cause a slicing ball flight, a hooking ball flight, an excessively low ball flight, or a ballooning ball flight.

The design of the head 102 shown in FIGS. 1-8 provides one such advantageous weight distribution. The face 112 and band 114 are constructed from metal, and the band 114 is positioned around the outer periphery of the head 102 and is below the volumetric or dimensional centerline of the head 102. Thus, the weight of the metal in the band 114 causes the center of gravity of the head 102 to be lower and creates a greater moment of inertia for the head 102, because the weight is proportionally distributed around the outer periphery of the head 102. The metal arm 136 extending across the bottom 138 of the head 102 further lowers the center of gravity of the head 102. Additionally, the lighter weight of the non-metallic top piece 118 further assists in keeping the center of gravity of the head 102 lower. Similarly, the lighter weight of the non-metallic bottom pieces 120, 122 make the center of the head 102 lighter, further assisting in keeping the weight distributed around the outer periphery of the head 102 and increasing the moment of inertia of the head 102. The addition of weight inserts 170, 174 can provide further weighting toward the bottom and outer periphery of the head 102. It is understood that other embodiments may be designed to weight the head 102 differently, according to the principles disclosed herein.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A ball striking device comprising:

a head comprising:

a metal face configured for striking a ball, wherein the face is formed by a cup face member that includes a ball striking face and a return portion extending rearward from a periphery of the ball striking face;

a metal band having a first end extending from a first side of the return portion, a second end extending from a second, opposed side of the return portion, and a rear portion extending between the first and second ends, the band and the return portion combining to define a first opening on a top side of the metal band and the band further defining a second opening on a bottom side of the metal band;

a substantially non-metallic top piece connected to the top side of the metal band and forming at least a portion of a top side of the head, wherein the top piece is positioned to cover the first opening and is larger than the first opening, such that a portion of the top piece engages an inner surface of the band and an inner surface of the return portion around the first opening to secure the top piece in place; and a substantially non-metallic bottom piece connected to the bottom side of the metal band and forming at least a portion of a bottom side of the head, wherein the bottom piece is positioned to cover the second opening and is larger than the second opening, such that a portion of the bottom piece engages the inner surface of the band around the second opening to secure the bottom piece in place, wherein the top piece and the bottom piece are separated by the metal band.

2. The ball striking device of claim 1, wherein the face and the band are made from the same metallic material.

3. The ball striking device of claim 1, wherein the top piece and the bottom piece are made from carbon fiber-polymer composite materials.

4. The ball striking device of claim 1, wherein the face and the band are formed separately and are connected by an integral joining technique, and the top piece and the bottom piece are connected to the band by an adhesive.

5. The ball striking device of claim 1, wherein the head further comprises a metal arm extending across the bottom side of the head from the face to a rear, central location of the band, wherein the second opening is defined by the band and the arm, and wherein the portion of the bottom piece further engages an inner surface of the arm around the second opening to secure the bottom piece in place.

6. The ball striking device of claim 5, wherein the first opening is defined between the bottom side of the band and a first side of the arm, and wherein a third opening is defined by the bottom side of the band and a second, opposed side of the arm, the head further comprising a second substantially non-metallic bottom piece connected to the bottom side of the band and forming at least a portion of a bottom side of the head, wherein the second bottom piece is positioned to cover the third opening and is larger than the third opening, such that a portion of the second bottom piece engages the inner surface of the band and the inner surface of the arm around the third opening to secure the second bottom piece in place wherein the first and second bottom pieces are separate from one another.

7. The ball striking device of claim 5, wherein the metal arm and the metal band are formed together as a single, unitary piece.

8. The ball striking device of claim 1, wherein the head further comprises at least one weight member connected to the metal band.

9. The ball striking device of claim 1, further comprising a shaft connected to the head.

10. A ball striking device comprising:

a head comprising:

a metal front piece comprising a cup face member that includes a face configured for striking a ball and at least one wall extending rearward from a periphery of the face;

a metal back piece extending from the front piece, the back piece and the at least one wall of the front piece defining a first opening on a top side thereof, and the back piece defining a second opening on a bottom side thereof;

a substantially non-metallic top piece connected to the back piece and the front piece and positioned to cover the first opening and forming part of an outer surface of the head, wherein the top piece is larger than the first opening and overlaps a periphery of the first opening, such that a portion of the top piece engages an inner surface of the back piece and an inner surface of the at least one wall around the periphery of the first opening to secure the top piece in place; and a substantially non-metallic bottom piece connected to the back piece and positioned to cover the second opening and forming part of the outer surface of the head, wherein the bottom piece is larger than the second opening and overlaps a periphery of the second opening, such that a portion of the bottom piece engages the inner surface of the band around the periphery of the second opening to secure the bottom piece in place, and wherein the back piece separates the bottom piece from top piece.

11. The ball striking device of claim 10, wherein the front piece and the back piece are made from the same metallic material.

12. The ball striking device of claim 10, wherein the top piece and the bottom piece are made from carbon fiber-polymer composite materials.

13. The ball striking device of claim 10, wherein the front piece and the back piece are formed separately and are connected by an integral joining technique, and the top piece and the bottom piece are connected to the back piece by an adhesive.

14. The ball striking device of claim 10, wherein the back piece further defines a third opening on the bottom side thereof, wherein the head further comprises a second bottom piece connected to the back piece and positioned to at least partially cover the third opening and forming part of the outer surface of the head, wherein the second bottom piece is larger than the third opening and overlaps a periphery of the third opening, such that a portion of the second bottom piece engages the inner surface of the band around the periphery of the third opening to secure the second bottom piece in place, and wherein the two bottom pieces do not contact one another.

15. The ball striking device of claim 10, wherein the head further comprises at least one weight member connected to the back piece.

16. The ball striking device of claim 10, further comprising a shaft connected to the head.

17. A method of forming a ball striking device comprising:

forming a metal front piece comprising a cup face member including a face configured for striking a ball and a return portion extending rearward from a periphery of the face;

forming a metal back piece having a front end and a rear end, the back piece comprising a band having a first end and a second end located at opposite edges of the front end and a rear portion extending between the first and second ends and forming the rear end of the back piece, and an arm extending from the front end of the back piece to the band at the rear end of the back piece, wherein the back piece is formed of a single, integral piece;

connecting the front piece to the back piece using an integral joining technique, such that the back piece and the return portion combine to define a first opening on a top side thereof, and wherein the back piece defines a second opening and a third opening on the bottom side thereof, wherein the second and third openings are defined between the band and the arm on opposite sides of the arm;

forming a substantially non-metallic top piece and two substantially non-metallic bottom pieces;

connecting the top piece to the back piece and the front piece, wherein the top piece engages inner surfaces of the return portion and the band and protrudes into the first opening to be positioned to cover the first opening and to form part of an outer surface of the ball striking device; and connecting the bottom pieces to the back piece, wherein the bottom pieces engage inner surfaces of the arm and the band and protrude into the second and third openings to be positioned to cover the second and third openings, wherein the back piece separates the bottom pieces from the top piece, and the arm separates the bottom pieces from each other.

18. The method of claim 17, further comprising connecting a shaft to at least one of the front piece and the back piece.

19. The method of claim 17, wherein the front piece and the back piece are made from the same metallic material.

20. The method of claim 17, wherein the top piece and the bottom piece are made from carbon fiber-polymer composite materials.

21. The method of claim 17, wherein the top piece and the bottom piece are connected to the back piece by an adhesive.

22. The method of claim 17, further comprising connecting at least one weight member to the back piece.

23. A golf club head comprising:

a metal face configured for striking a ball, wherein the face is formed by a cup face member that includes a ball striking face and a return portion extending rearward from a periphery of the ball striking face;

a metal band having a first end extending from a first side of the return portion, a second end extending from a second, opposed side of the return portion, and a rear portion extending between the first and second ends;

a metal arm extending across a bottom side of the head from the face to a rear, central location of the band, wherein the face, the band, and the arm are integrally joined together to form a single piece;

a non-metallic top piece connected to a top side of the metal band and forming at least a portion of a top side of the head, wherein the top piece engages an inner surface of the metal band and an inner surface of the return portion; and a pair of non-metallic bottom pieces connected to opposite sides of the arm and to a bottom side of the metal band and forming at least a portion of a bottom side of the head, wherein each of the bottom pieces engages an inner surface of the metal band and an inner surface of the arm, wherein the top piece and the bottom piece are separated by the metal band.

24. The golf club head of claim 23, wherein the top piece and the bottom piece are made from carbon fiber-polymer composite materials.

25. The golf club head of claim 23, wherein the face is formed of a first piece and the band and the arm are formed together as a second piece, and the first and second pieces are connected by an integral joining technique to form the single piece, and the top piece and the bottom piece are connected to the band by an adhesive.

26. A golf club comprising:

a golf club head according to claim 23; and a shaft connected to the golf club head.

27. A golf club head comprising:

a metal front piece comprising a cup face structure including a face configured for striking a ball and a return portion extending rearward from a periphery of the face;

a metal back piece extending from the front piece, the back piece and the return portion defining a first opening on a top side thereof, and the back piece defining a second opening on a bottom side thereof, wherein the back piece includes ridges extending around the first and second openings and located on an inner surface of the back piece;

a non-metallic top piece connected to the back piece and positioned to at least partially cover the first opening, wherein the top piece engages the inner surface of the back piece and an inner surface of the return portion and further engages the ridge extending around the first opening to secure the top piece in place; and a non-metallic bottom piece connected to the back piece and positioned to at least partially cover the second opening, wherein the bottom piece does not contact the top piece, and wherein the bottom piece engages the inner surface of the back piece and further engages the ridge extending around the second opening to secure the bottom piece in place.

28. The golf club head of claim 27, wherein the top piece and the bottom piece are made from carbon fiber-polymer composite materials.

29. The golf club head of claim 27, wherein the front piece and the back piece are formed separately and are connected by an integral joining technique, and the top piece and the bottom piece are connected to the back piece by an adhesive.

30. The golf club head of claim 27, wherein the back piece further defines a third opening on the bottom side thereof, the back piece including a ridge extending around the third opening and located on the inner surface of the back piece, wherein the head further comprises another bottom piece connected to the back piece and positioned to at least partially cover the third opening, wherein the other bottom piece engages the ridge extending around the third opening to secure the bottom piece in place, and wherein the two bottom pieces do not contact one another.

31. The golf club head of claim 27, wherein the front piece has a cup-face structure and comprises the face and at least one wall extending rearwardly from a periphery of the face, and the back piece is formed separately from the front piece and is connected to the front piece by the at least one wall.

32. A golf club comprising:

a golf club head according to claim 27; and a shaft connected to the golf club head.

33. A ball striking device comprising:

a structural frame formed of a first material, the frame comprising:

a face configured for striking a ball, the face being formed by a cup face structure including the face and at least one wall extending rearward from a periphery of the face; and a band connected to the at least one wall of the cup face structure and extending around a rear periphery of the frame, wherein the band and the at least one wall cooperate to define a first opening on a top side of the band and the band defines a second opening on the bottom side of the band, the first opening being separate from the second opening, and wherein the band includes ridges extending around the first and second openings and located on an inner surface of the band;

a first non-structural piece formed of a second material and positioned to cover the first opening, wherein the first non-structural piece is larger than the first opening, such that a portion of the first non-structural piece engages the inner surface of the band and an inner surface of the at least one wall around the first opening and further engages the ridge extending around the first opening to secure the first non-structural piece in place; and a second non-structural piece formed of the second material and positioned to cover the second opening, wherein the second non-structural piece is larger than the second opening, such that a portion of the second non-structural piece engages the inner surface of the band around the second opening and further engages the ridge extending around the second opening to secure the second non-structural piece in place.

* * * * *